US008253479B2

(12) United States Patent
Haddad et al.

(10) Patent No.: US 8,253,479 B2
(45) Date of Patent: Aug. 28, 2012

(54) OUTPUT DRIVER CIRCUITS FOR VOLTAGE REGULATORS

(75) Inventors: Sandro A. P. Haddad, Campinas (BR); Jose A. Palazzi, Sao Paulo (BR); Andre Luis Vilas Boas, Campinas (BR)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 12/621,696

(22) Filed: Nov. 19, 2009

(65) Prior Publication Data

US 2011/0115452 A1 May 19, 2011

(51) Int. Cl.
*G05F 1/10* (2006.01)

(52) U.S. Cl. ..... 327/540; 327/541; 327/543

(58) Field of Classification Search ..... 327/540–541, 327/543

See application file for complete search history.

(56) References Cited

U.S. PATENT DOCUMENTS 4,914,317 A * 4/1990 Agiman ..... 327/108
5,252,910 A * 10/1993 Agaesse ..... 323/315
5,867,067 A * 2/1999 Moriarty, Jr. ..... 330/288
5,945,819 A 8/1999 Ursino et al.
6,054,845 A * 4/2000 Feldtkeller ..... 323/277
6,100,749 A * 8/2000 Itoh ..... 327/530
6,157,176 A 12/2000 Pulvirenti et al.
6,388,433 B2 5/2002 Marty
7,199,565 B1 4/2007 Demolli
2008/0180080 A1 7/2008 Terry et al.

FOREIGN PATENT DOCUMENTS

EP 1933221 A1 6/2008

OTHER PUBLICATIONS

Den Besten et al.; "Embedded 5 V-to-3.3 V Voltage Regulator for Supplying Digital IC's in 3.3 V CMOS Technology"; IEEE Journal of Solid-State Circuits; Jul. 1998; pp. 956-962; vol. 33, No. 7.

* cited by examiner

*Primary Examiner* — Kenneth B. Wells

(57) ABSTRACT

An output driver circuit having an input stage and an output stage, wherein the output stage and the input stage are configured to function as (1) a low-frequency voltage follower and (2) a high-frequency feedback loop for the output driver circuit. In operation, the low-frequency follower and the high-frequency feedback loop may precisely regulate the output voltage of the output driver circuit when large load transients occur. A compact charge pump may be used to supply additional voltage required to operate a current mirror of the output driver circuit.

17 Claims, 7 Drawing Sheets

OUTPUT DRIVER CIRCUITS FOR VOLTAGE REGULATORS

BACKGROUND

1. Field

This disclosure relates generally to output driver circuits, and more specifically, to output driver circuits for voltage regulators.

2. Related Art

In order to maintain output voltage within a tolerable range, voltage regulators typically have large output drivers. While such large output drivers can maintain the output voltage within the tolerable range, they pose several design issues. For example, such large output drivers use large NMOS transistors that occupy a substantial amount of area on an integrated circuit die. Additionally, such large NMOS transistors have a high gate to source capacitance and thus require, at their gates, additional large capacitors. The addition of these large capacitors further exacerbates the problem associated with the output drivers taking up a large area on the integrated circuit die.

Accordingly, there is a need for output driver circuits that can maintain the output voltage within a tolerable range and yet not occupy a large area on the integrated circuit die.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Figure 1:
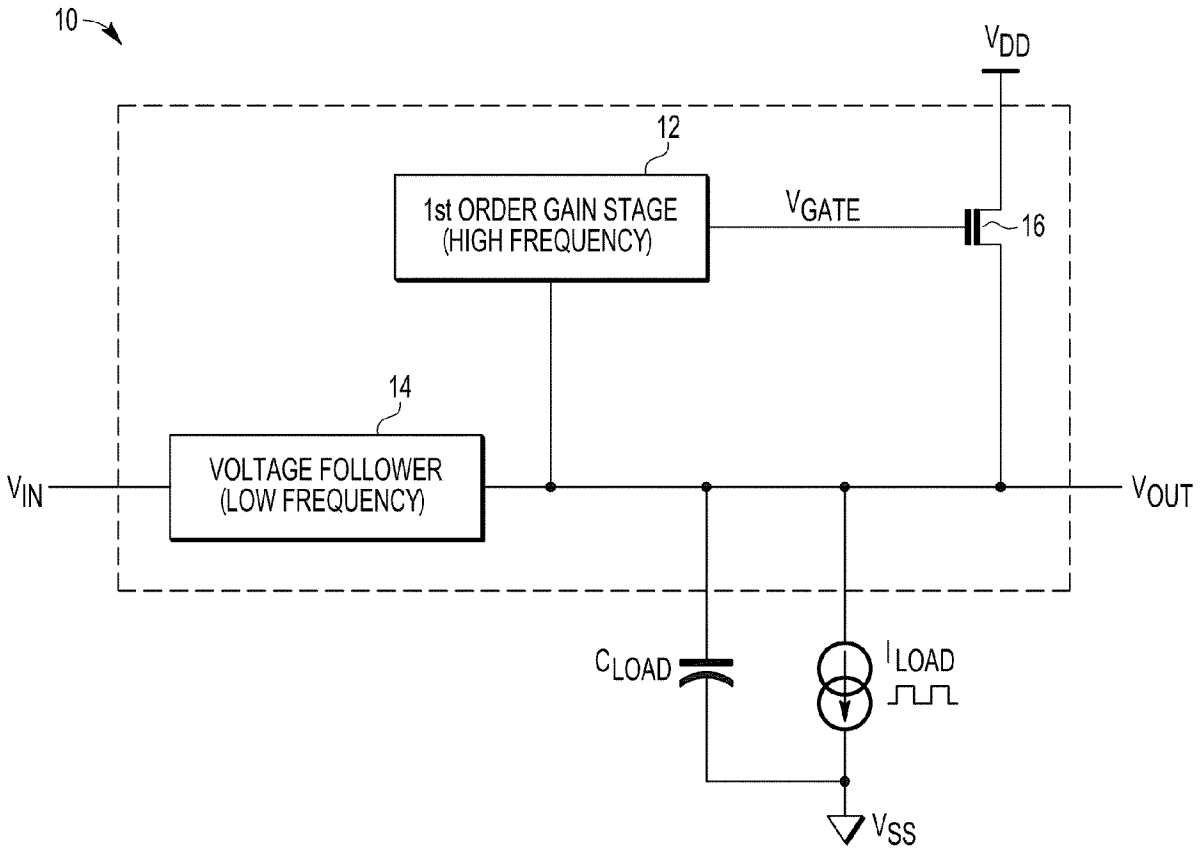
FIG. 1 is a block diagram of an exemplary output driver circuit.

In one aspect, an output driver circuit having a first n-type transistor having a first terminal coupled to a first power supply voltage, a second terminal coupled to at least one load, and a control terminal is provided. The output driver circuit may further include an input stage comprising a second n-type transistor having a first terminal coupled to a first biasing current terminal and the control terminal of the first n-type transistor, a second terminal coupled to receive an input voltage and coupled to a second biasing current terminal, and a control terminal. The output driver circuit may further include an output stage comprising a third n-type transistor having a control terminal coupled to the control terminal of the second n-type transistor of the input stage, a first terminal coupled to a third biasing current terminal and the control terminal of the third n-type transistor of the input stage, and a second terminal coupled to the second terminal of the first n-type transistor and coupled to a fourth biasing current terminal, wherein the output stage and the input stage are configured to function as (1) a low-frequency voltage follower and (2) a high-frequency feedback loop for the output driver circuit.

In another aspect, an output driver circuit having a first n-type transistor having a first terminal coupled to a first power supply voltage, a second terminal coupled to at least one load, and a control terminal is provided. The output driver circuit may further include an input stage comprising a second n-type transistor having a first terminal coupled to a first biasing current terminal and the control terminal of the first n-type transistor, a second terminal coupled to receive an input voltage and coupled to a second biasing current terminal, and a control terminal. The output driver circuit may further include an output stage comprising a third n-type transistor having a control terminal coupled to the control terminal of the second n-type transistor of the input stage, a first terminal coupled to a third biasing current terminal and the control terminal of the second n-type transistor of the input stage, and a second terminal coupled to the second terminal of the output driver, such that when a load current associated with the at least one load increases or decreases, a feedback current is provided via the control terminal of the first n-type transistor to attenuate a magnitude of a transient response at an output of the output driver circuit.

In yet another aspect, an output driver circuit having an output driver stage, an input stage, and an output stage is provided. The output driver stage may include: (1) a first n-type transistor having a first terminal coupled to a first power supply voltage, a second terminal coupled to at least one load, and a control terminal is provided; (2) a low-pass filter having an input coupled to the control terminal of the first n-type transistor and an output; and (3) a second n-type transistor having a first terminal coupled to the first power supply voltage, a second terminal coupled to the at least one node, and a control terminal coupled to the output of the low-pass filter. The output driver circuit may further include an input stage and an output stage. The input stage may include: (1) a third n-type transistor having a first terminal coupled to a first biasing current terminal and the control terminal of the first n-type transistor, a second terminal coupled to receive an input voltage and coupled to a second biasing current terminal, and a control terminal; (2) a first p-type transistor having a first terminal coupled to the first biasing current terminal, a second terminal coupled to the first voltage supply node, and a control terminal coupled to receive a first bias voltage; and (3) a fourth n-type transistor having a first terminal coupled to the second terminal of the third n-type transistor of the input stage, a second terminal coupled to a second voltage supply node, and a control terminal coupled to receive a second bias voltage. The output stage may further include: (1) a fifth n-type transistor having a control terminal coupled to the control terminal of the third n-type transistor of the input stage, a first terminal coupled to a third biasing current terminal and the control terminal of the third n-type transistor of the input stage, and a second terminal coupled to the second terminal of the first n-type transistor; (2) a second p-type transistor having a first terminal coupled to the third biasing current terminal, a second terminal coupled to the first voltage supply node, and a control terminal coupled to receive a third bias voltage; and (3) a sixth n-type transistor having a first terminal coupled to the second terminal of the fifth n-type transistor of the output stage, a second terminal coupled to the second voltage supply node, and a control terminal coupled to receive a fourth bias voltage, such that when a load current associated with the at least one load increases or decreases, a feedback current is provided via the control terminal of the first n-type transistor to attenuate a magnitude of a transient response at an output of the output driver circuit.

FIG. 1 is a block diagram of an exemplary output driver circuit 10. Output driver circuit 10 may include a 1st order gain stage 12, a voltage follower 14, and an n-type transistor 16. Output driver circuit 10 may receive an input voltage VIN and provide an output voltage VOUT, which in turn could be coupled to a load to provide load current ILOAD. By way of example, 1st order gain stage 12 may be used to provide a high-frequency feedback loop to maintain the output voltage VOUT steady when large load transients occur; and voltage follower 14 may be used as a low-frequency voltage follower (buffer) to precisely regulate the output voltage VOUT. In operation, when there is a step increase in load current ILOAD, 1st order gain stage 12 and voltage follower 14 may almost instantaneously increase the voltage at the gate (VGATE) of n-type transistor 16. This in turn would result in an increased gate to source voltage for n-type transistor 16 resulting in lower voltage ripple at an output of output driver circuit 10.

Figure 2:
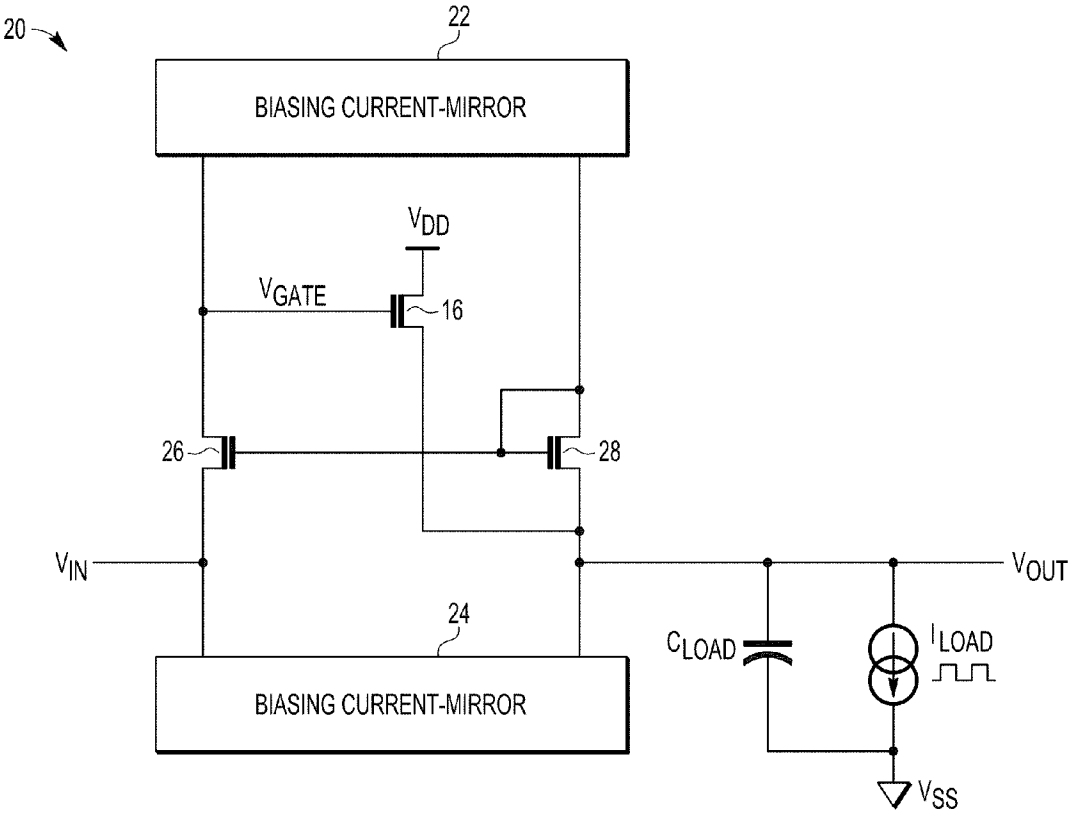
FIG. 2 is a block diagram of another exemplary output driver circuit.

FIG. 2 is a block diagram of another exemplary output driver circuit 20. In one embodiment, output driver circuit 20 may be an implementation of output driver circuit 10 of FIG. 1. In one embodiment, output driver circuit 20 may include an n-type transistor 16, for example, which may be configured to function as an output device of the output driver circuit 20. The output driver circuit 20 may further include a biasing current-mirror 22 and another biasing current-mirror 24. The output driver circuit 20 may further include two other n-type transistors 26 and 28. A first terminal of n-type transistor 16 may be coupled to a power supply voltage VDD; a second terminal of n-type transistor 16 may be coupled to at least one load that may require load current ILOAD. The output driver circuit 20 may further include an input stage and an output stage. The input stage may include n-type transistor 26 having a first terminal coupled to a biasing current terminal (e.g., a terminal coupled to biasing current-mirror 22) and the control terminal of n-type transistor 16. A second terminal of n-type transistor 26 may be coupled to receive an input voltage VIN and may also be coupled to another biasing current-terminal (e.g., a terminal coupled to biasing current-mirror 24). The input voltage VIN may be received from an output of a voltage regulator. Alternatively, the input voltage VIN may be a band-gap voltage or a reference voltage.

The output stage may further include an n-type transistor 28 having a control terminal coupled to the control terminal of n-type transistor 26 of the input stage, a first terminal coupled to a biasing current terminal (e.g., a terminal coupled to biasing current-mirror 22) and the control terminal of n-type transistor 26 of the input stage, and a second terminal coupled to the second terminal of n-type transistor 16. In one embodiment, the output stage and the input stage may be configured to function as (1) a low-frequency voltage follower and (2) a high-frequency feedback loop for the output driver circuit. In operation, when there is a step increase in load current ILOAD, 1st order gain stage 12 and voltage follower 14 may almost instantaneously increase the voltage at the gate (VGATE) of n-type transistor 16. This in turn would result in an increased gate to source voltage for n-type transistor 16 resulting in lower voltage ripple at an output of output driver circuit 20. By way of additional explanation, in one embodiment, during low frequency (e.g., DC) operation, n-type transistor 28 and n-type transistor 26 operate as a voltage follower (buffer) and during high-frequency operation, n-type transistor 28 acts as a 1-stage voltage amplifier. When there is a load step applied at the output (e.g., terminal providing the output voltage VOUT), the loop consisting of n-type transistor 26 (acting as a voltage-follower) and n-type transistor 28 (acting as an amplifier stage) instantaneously increases the voltage at the gate (VGATE) of n-type transistor 16. This in turn increases the gate to source voltage of n-type transistor 16 (acting as the output driver), which in turn reduces the voltage ripple (undershoot and/or overshoot) at the output (e.g., terminal providing the output voltage VOUT). Although FIG. 2 shows a simpler schematic, including a simple current mirror structure formed by n-type transistors 26 and 28, more advanced current mirror topologies, such as cascaded current mirrors can be used.

Figure 3:
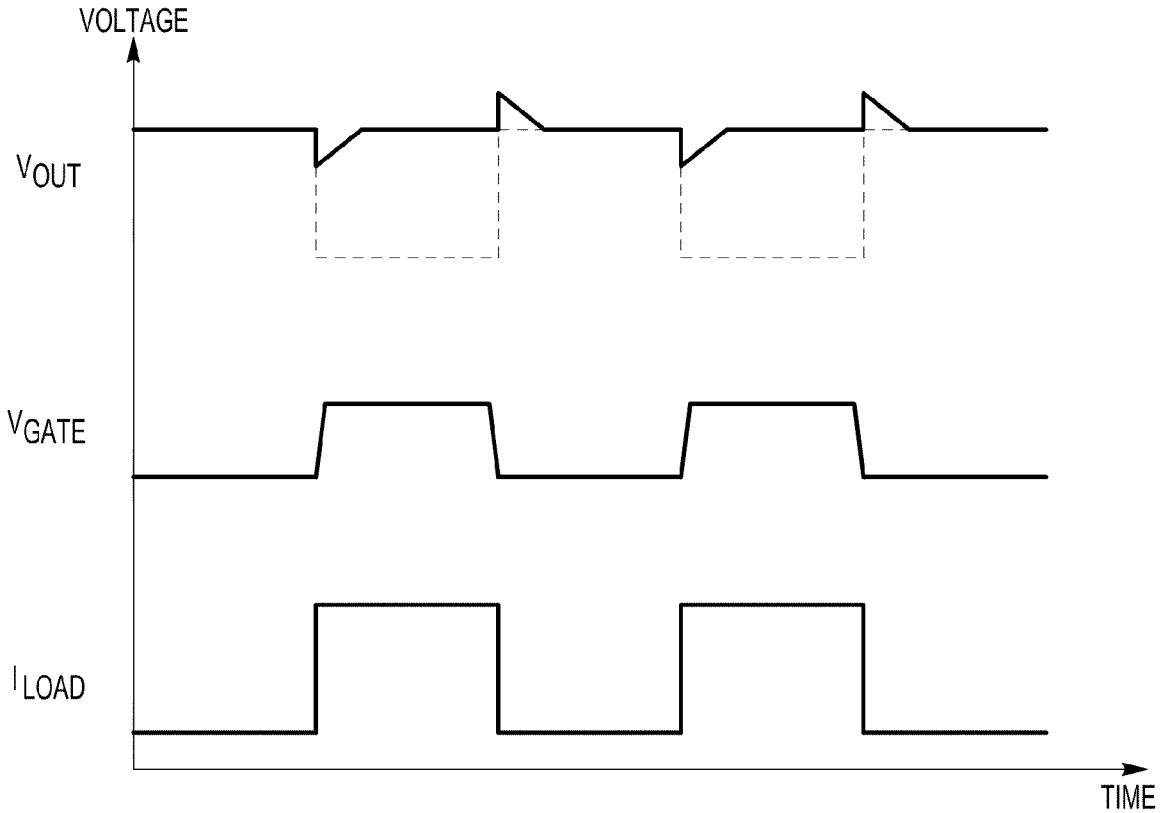
FIG. 3 is a timing diagram showing the voltage response of an exemplary output driver circuit.

FIG. 3 is a timing diagram showing the voltage response of an exemplary output driver circuit. In general, FIG. 3 shows that output driver circuit 20 maintains the output voltage $V_{OUT}$ within a high degree of accuracy despite significant changes in the load current $I_{LOAD}$. As explained earlier, this happens because as the load current $I_{LOAD}$ increases, the voltage at the gate ($V_{GATE}$) of n-type transistor 16 increases, which in-turn helps reduce the undershoot associated with the output voltage $V_{OUT}$.

Figure 4:
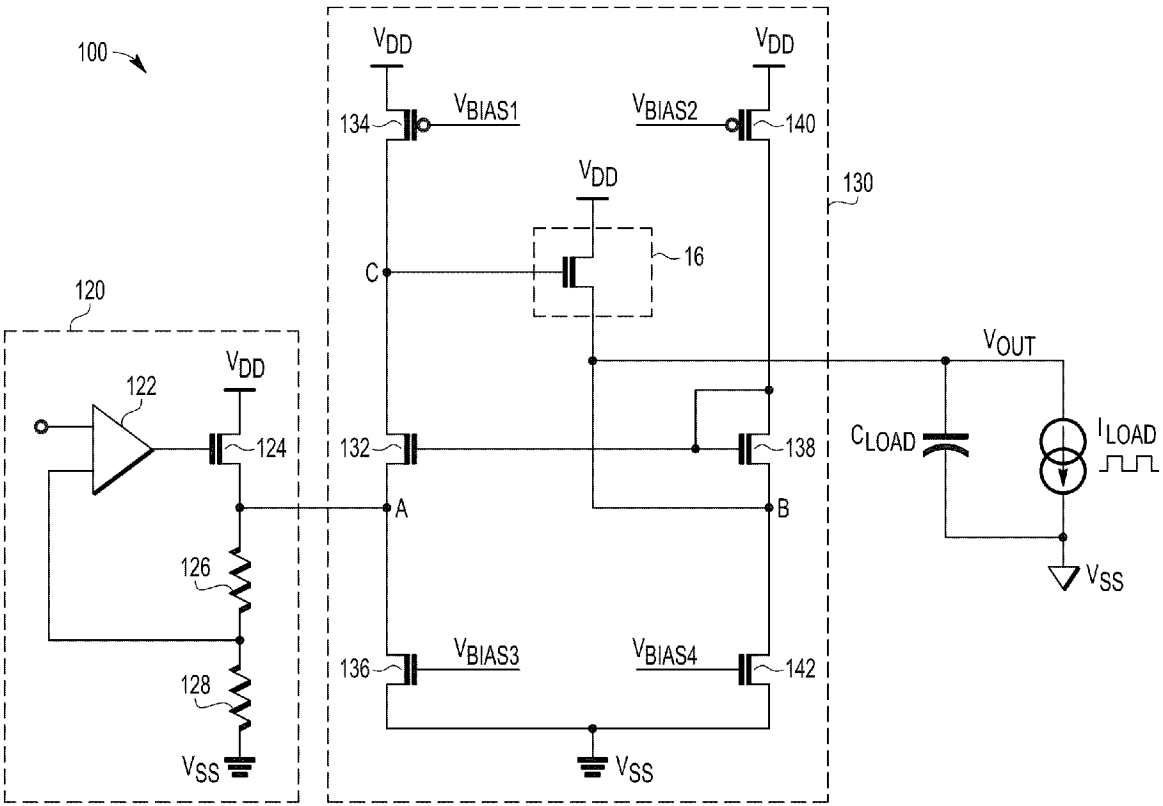
FIG. 4 is a schematic diagram of an exemplary implementation of an output driver circuit.

FIG. 4 is a schematic diagram of an exemplary implementation of an output driver circuit 130 used in combination 100 with a voltage regulator 120. Voltage regulator 120 may include a differential amplifier 122, FET transistor 124, and resistors 126 and 128. In one embodiment, one input of differential amplifier 122 may be a voltage reference, such as a bandgap reference and the other input may be a voltage provided by the combination of resistors 126 and 128. As the output voltage of voltage regulator 120 rises in relation to the reference voltage, the drive to FET transistor 124 changes thereby maintaining a relatively constant voltage at the output of voltage regulator 120. Output driver circuit 130 may include an n-type transistor 16 having a first terminal coupled to power supply voltage $V_{DD}$. A second terminal of n-type transistor 16 may be coupled to at least one load. Output driver circuit 130 may further include an input stage and an output stage. The input stage may include: an n-type transistor 132, a p-type transistor 134, and another n-type transistor 136. A first terminal of n-type transistor 132 may be coupled to a first biasing current terminal and the control terminal of the n-type transistor 16. A second terminal of n-type transistor 132 may be coupled to receive an input voltage and coupled to a second biasing current terminal. The input voltage $V_{IN}$ may be received from an output of a voltage regulator 120, for example. Although FIG. 4 shows the input voltage as being the output voltage of a voltage regulator, the input voltage $V_{IN}$ may be a band-gap voltage or a reference voltage. A first terminal of p-type transistor 134 may be coupled to a biasing current terminal and a second terminal of p-type transistor 134 may be coupled to receive the power supply voltage $V_{DD}$. A control terminal of p-type transistor 134 may be to receive a bias voltage (e.g., bias voltage $V_{BIAS1}$). A first terminal of n-type transistor 136 may be coupled to the second terminal of the n-type transistor 132 of the input stage. A second terminal of the n-type transistor 136 may be coupled to receive the ground voltage $V_{Ss}$. And a control terminal of n-type transistor 136 coupled to receive a bias voltage (e.g., bias voltage $V_{BIAS3}$).

With continuing reference to FIG. 4, the output stage may further include: an n-type transistor 138, a p-type transistor 140, and another n-type transistor 142. A control terminal of n-type transistor 138 may be coupled to the control terminal of n-type transistor 132 of the input stage. A first terminal of n-type transistor 138 may be coupled to a biasing current terminal and the control terminal of n-type transistor 132 of the input stage. A second terminal of n-type transistor 138 may be coupled to the second terminal of n-type transistor 16 and another biasing current terminal. A first terminal of p-type transistor 140 may be coupled to another biasing current terminal. A second terminal of p-type transistor 140 may be coupled to receive power supply voltage $V_{DD}$. A control terminal of p-type transistor 140 may be coupled to receive a bias voltage (e.g., bias voltage $V_{BIAS3}$). And a first terminal of n-type transistor 142 may be coupled to the second terminal of n-type transistor 138 of the output stage. A second terminal of n-type transistor 142 may be coupled to receive the ground voltage $V_{SS}$. A control terminal of n-type transistor 142 may be coupled to receive a bias voltage (e.g., bias voltage $V_{BIAS4}$), such that when a load current associated with the at least one load increases or decreases, a feedback current is provided via the control terminal of n-type transistor 16 to attenuate a magnitude of a transient response at an output (e.g., output voltage $V_{OUT}$) of output driver circuit 130. Although FIG. 4 shows a specific number of components arranged in a specific manner, there may be fewer or more components arranged differently.

Figure 5:
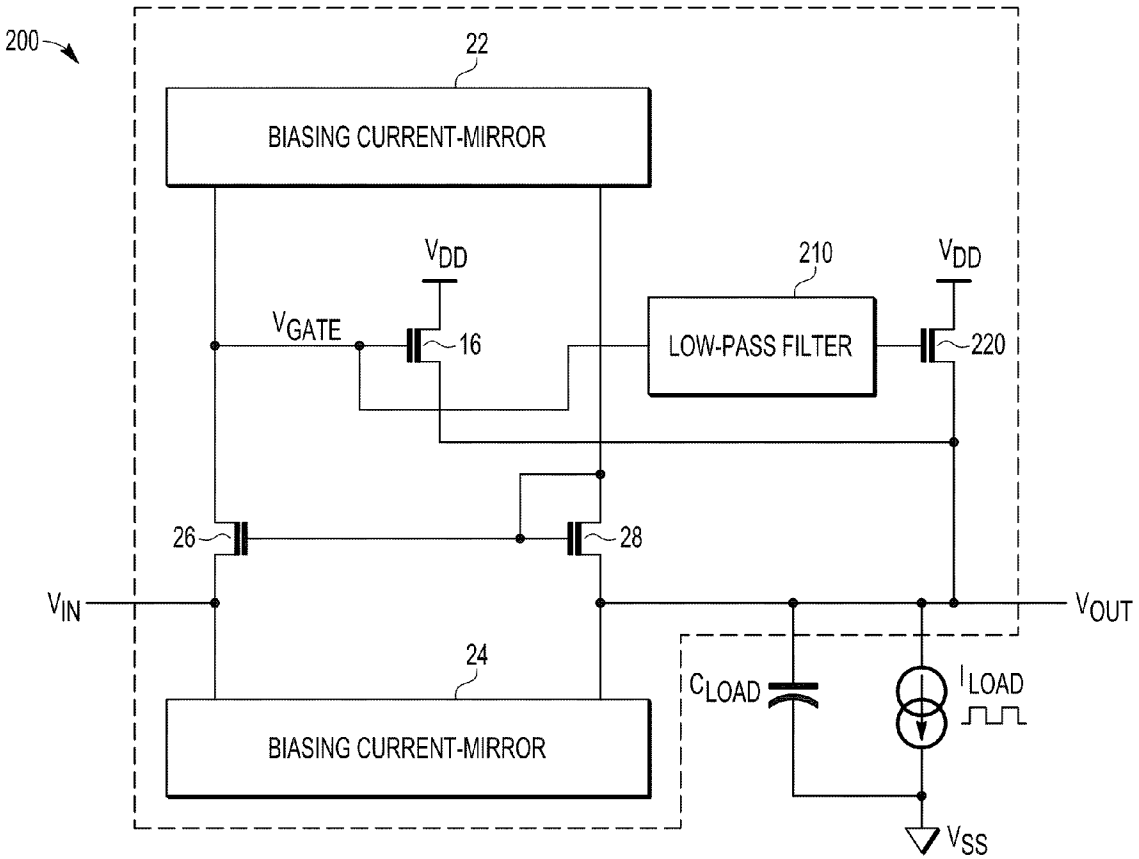
FIG. 5 is a block diagram of another exemplary output driver circuit.

FIG. 5 is a block diagram of another exemplary output driver circuit 200. Exemplary output driver circuit 200 may include the same components as described with reference to FIG. 2 and it may further include a low-pass filter 210 and an n-type transistor 220. In one embodiment, the gate of n-type transistor 16 may be coupled to an input of low-pass filter 210. An output of low-pass filter 220 may further be coupled to the gate of n-type transistor 220. The drain of n-type transistor 220 may be coupled to power supply voltage $V_{DD}$. And, the source of n-type transistor 220 may be coupled to output voltage $V_{OUT}$. Although FIG. 5 shows a specific number of components arranged in a specific manner, there may be fewer or more components arranged differently.

Figure 6:
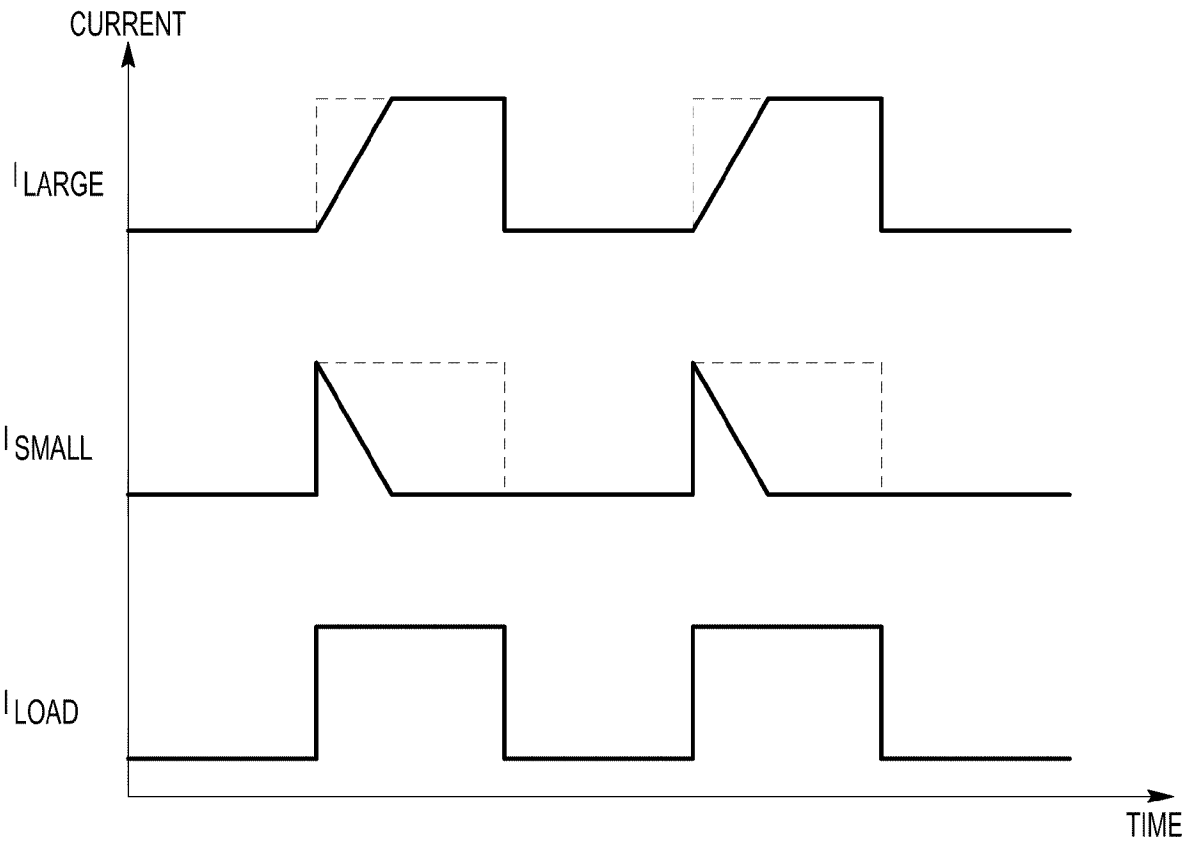
FIG. 6 is a timing diagram showing certain current waveforms of the exemplary output driver circuit of FIG. 5.

The operation of output driver circuit is further explained with reference to FIG. 6, which shows a timing diagram. By way of example, as load current $I_{LOAD}$ changes, initially, $I_{SMALL}$ provides most of the load current $I_{LOAD}$, but after $I_{LARGE}$ increases, it provides most of the load current $I_{LOAD}$. As a result, n-type transistor 16 may turn-off, while n-type transistor continues to provide current.

Figure 7:
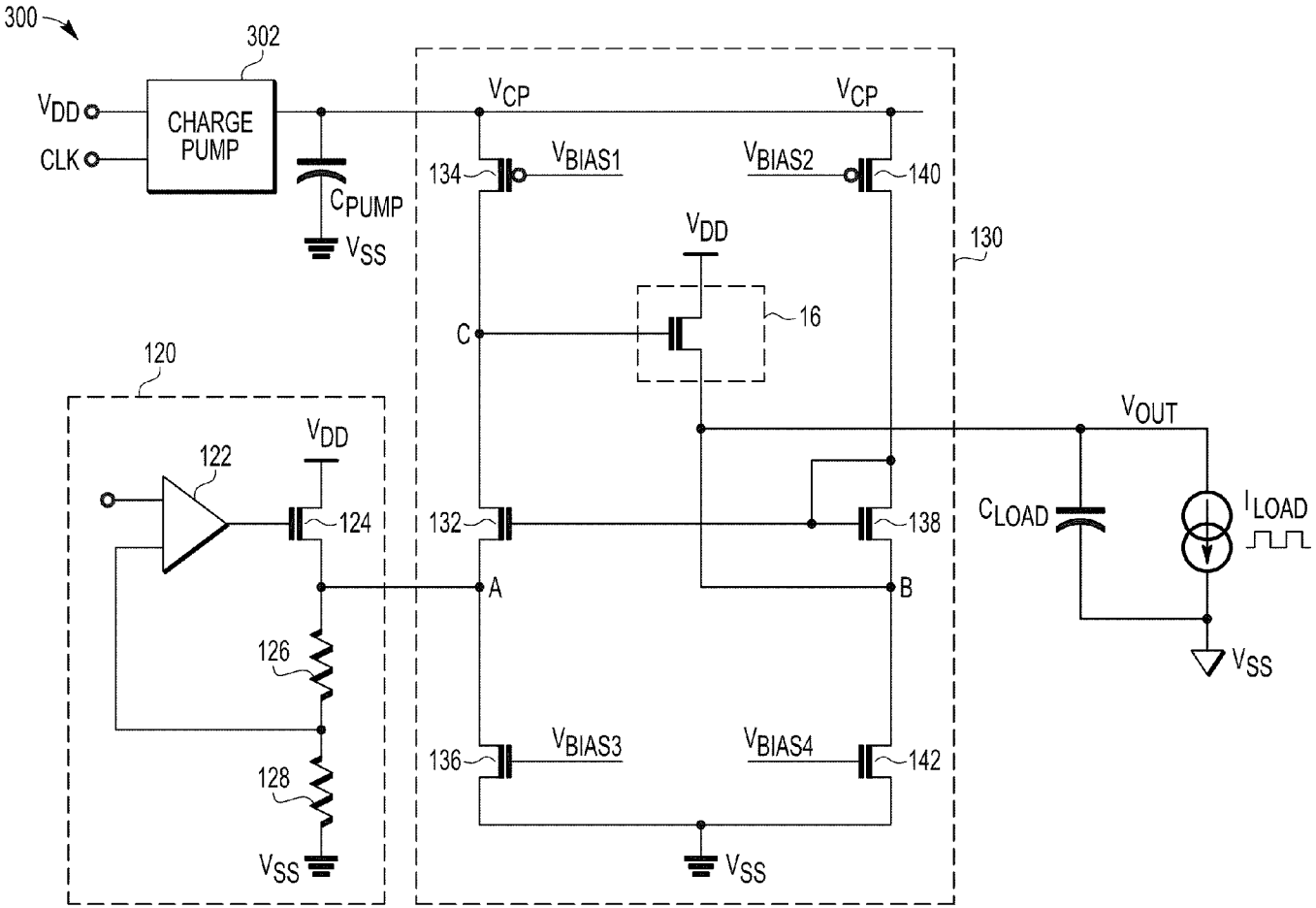
FIG. 7 is a schematic diagram of another exemplary implementation of an output driver circuit.

FIG. 7 is a schematic diagram of another exemplary implementation of an output driver circuit 300. By way of example, output driver circuit 300 may include the components described with respect to FIG. 4 and may further include charge pump 302. Charge pump 302 is used to provide an upper voltage level $V_{CP}$ (approximately twice a power supply voltage $V_{DD}$), for example). Charge pump 302 is used to supply voltage only to the current mirror (including transistors 134, 136, 138, and 140, for example) of output driver circuit 300. This way charge pump 302 does not experience load transients and thus needs only a small output capacitor $C_{PUMP}$. Although FIG. 7 shows a specific number of components arranged in a specific manner, there may be fewer or more components arranged differently.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

It is to be understood that the circuits depicted herein are merely exemplary. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the functionality of the above described operations merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. An output driver circuit comprising:

a first NMOS transistor having a first terminal directly connected to a first power supply voltage, a second terminal directly connected to at least one external load circuit, and a control terminal, wherein the first NMOS transistor conducts a load current; and a second NMOS transistor having a first terminal directly connected to a first biasing current terminal and the control terminal of the first NMOS transistor, a second terminal coupled to receive an external constant input voltage reference and directly connected to a second biasing current terminal, and a control terminal;

a third NMOS transistor having a control terminal directly connected to the control terminal of the second NMOS transistor, a first terminal coupled to a third biasing current terminal and the control terminal of the second NMOS transistor, and a second terminal directly connected to the second terminal of the first NMOS transistor and directly connected to a fourth biasing current terminal, wherein the second and third NMOS transistors and the biasing current terminals are configured as a low-frequency voltage follower circuit that regulates the output voltage of the output driver circuit; and the first NMOS transistor is configured as a first order gain stage high frequency feedback loop for the output driver circuit.

2. The output driver circuit of claim 1, wherein the first NMOS transistor supplies all the current demanded by a load to provide constant voltage to the load.

3. The output driver circuit of claim 1, wherein the first terminal of the second NMOS transistor is directly connected to the external constant input voltage reference such that the input voltage defines output voltage of the output driver circuit.

4. The output driver circuit of claim 1, wherein the second terminal of the second NMOS transistor provides input to the output driver circuit and the second terminal of the first NMOS transistor is the output of the output driver circuit.

5. The output driver circuit of claim 1, further comprising a first PMOS transistor having a first terminal directly connected to the control terminal of the first NMOS transistor terminal, a second terminal directly connected to a first voltage supply node, and a control terminal to receive a first bias voltage.

6. The output driver circuit of claim 5, further comprising a second PMOS transistor having a first terminal directly connected to the control terminal of the third NMOS transistor terminal, a second terminal directly connected to the first voltage supply node, and a control terminal to receive a second bias voltage.

7. The output driver circuit of claim 6, further comprising a fourth NMOS transistor having a first terminal directly connected to the second terminal of the second NMOS transistor, a second terminal directly connected to a second voltage supply node, and a control terminal to receive a third bias voltage.

8. The output driver circuit of claim 7, further comprising a fifth NMOS transistor having a first terminal directly connected to the second terminal of the third NMOS transistor, a second terminal directly connected to the second voltage supply node, and a control terminal coupled to receive a fourth bias voltage, wherein the third bias voltage has the same value in magnitude of the fourth bias voltage.

9. The output driver circuit of claim 1, further comprising a first PMOS current mirror transistor having a first terminal directly connected to the control terminal of the first NMOS transistor terminal, a second terminal directly connected to a third voltage supply node higher than the other two voltage supplies, and a control terminal to receive a first bias voltage; and a second PMOS transistor having a first terminal directly connected to the control terminal of the third NMOS transistor, a second terminal directly connected to a third voltage supply node higher than the other two voltage supplies, and a control terminal to receive a second bias voltage, wherein when the first and second PMOS terminals are configured as above the output driver circuit performs as low dropout (LDO) output driver circuit.

10. An output driver circuit comprising:

a first NMOS transistor having a first terminal directly connected to a first power supply voltage, a second terminal directly connected to at least one external load circuit, and a control terminal, wherein the first NMOS transistor conducts load current;

a second NMOS transistor having a first terminal directly connected to a first biasing current terminal and the control terminal of the first NMOS transistor, a second terminal to receive an external constant reference voltage and directly connected to a second biasing current terminal, and a control terminal; and a third NMOS transistor having a control terminal directly connected to the control terminal of the second NMOS transistor, a first terminal coupled to a third biasing current terminal and the control terminal of the second NMOS transistor, and a second terminal directly connected to the second terminal of the first NMOS transistor and directly connected to a fourth biasing current terminal, such that when a load current associated with the at least one load increases or decreases, a feedback signal is provided via the control terminal of the first NMOS transistor to maintain voltage at an output of the output driver circuit constant and equal in value to the external constant reference voltage.

11. The output driver circuit of claim 10, wherein the first NMOS transistor supplies all the current demanded by a load to provide constant voltage to the load.

12. The output driver circuit of claim 10, wherein the first terminal of the second NMOS transistor is directly connected to the external constant input voltage reference such that the input voltage defines output voltage of the output driver circuit.

13. The output driver circuit of claim 10, wherein the second terminal of the second NMOS transistor provides input to the output driver circuit and the second terminal of the first NMOS transistor is the output of the output driver circuit.

14. The output driver circuit of claim 10, further comprising a first PMOS transistor having a first terminal directly connected to the control terminal of the first NMOS transistor terminal, a second terminal directly connected to a first voltage supply node, and a control terminal to receive a first bias voltage.

15. The output driver circuit of claim 14, further comprising a second PMOS transistor having a first terminal directly connected to the control terminal of the third NMOS transistor terminal, a second terminal directly connected to the first voltage supply node, and a control terminal to receive a second bias voltage.

16. The output driver circuit of claim 15, further comprising a fourth NMOS transistor having a first terminal directly connected to the second terminal of the second NMOS transistor, a second terminal directly connected to a second voltage supply node, and a control terminal to receive a third bias voltage.

17. The output driver circuit of claim 16, further comprising a fifth NMOS transistor having a first terminal directly connected to the second terminal of the third NMOS transistor, a second terminal directly connected to the second voltage supply node, and a control terminal to receive a fourth bias voltage.

* * * * *